United States Patent [19]

Eigenbrod et al.

[11] Patent Number: 4,999,221

[45] Date of Patent: Mar. 12, 1991

[54] PROCESS FOR PLASTIC COATING, AND COATING PRODUCED BY THE PROCESS

[75] Inventors: Volkmar Eigenbrod, Kapellstrasse 30, 4000 Düsseldorf 30; Hans-Jürgen Hendriock, Burghausen, both of Fed. Rep. of Germany

[73] Assignees: Volkmar Eigenbrod, Düsseldorf; Hoechst Aktiengesellschaft, Frankfurt am Main, both of Fed. Rep. of Germany

[21] Appl. No.: 456,072

[22] Filed: Dec. 22, 1989

Related U.S. Application Data

[63] Continuation of Ser. No. 88,946, Aug. 24, 1987, abandoned.

[30] Foreign Application Priority Data

Aug. 23, 1986 [DE] Fed. Rep. of Germany ..... 3628670

[51] Int. Cl.[5] ..... B05D 3/02

[52] U.S. Cl. ..... 427/195; 427/202; 427/407.1

[58] Field of Search ..... 427/195, 202, 407.1

[56] References Cited

U.S. PATENT DOCUMENTS

| | | | |
|---|---|---|---|
| 3,207,358 | 9/1965 | Fliss | 427/195 X |
| 3,348,995 | 10/1967 | Baker et al. | 427/195 X |
| 3,920,793 | 11/1975 | Teti | 427/195 X |
| 4,154,876 | 5/1979 | Segawa et al. | 427/195 |
| 4,196,256 | 4/1980 | Eddy et al. | 427/195 |
| 4,685,985 | 8/1987 | Stueke | 427/195 |

FOREIGN PATENT DOCUMENTS

| | | | |
|---|---|---|---|
| 702044 | 1/1965 | Canada | 427/195 |

*Primary Examiner*—Shrive Beck

*Attorney, Agent, or Firm*—Toren, McGeady & Associates

[57] ABSTRACT

In a process for powder coating high temperature resistant surfaces with multilayer coatings, particularly of fluoroplastics, thick coatings can be obtained by maintaining the flowability of the layer previously applied below its run-off limit while applying a subsequent layer.

11 Claims, 1 Drawing Sheet

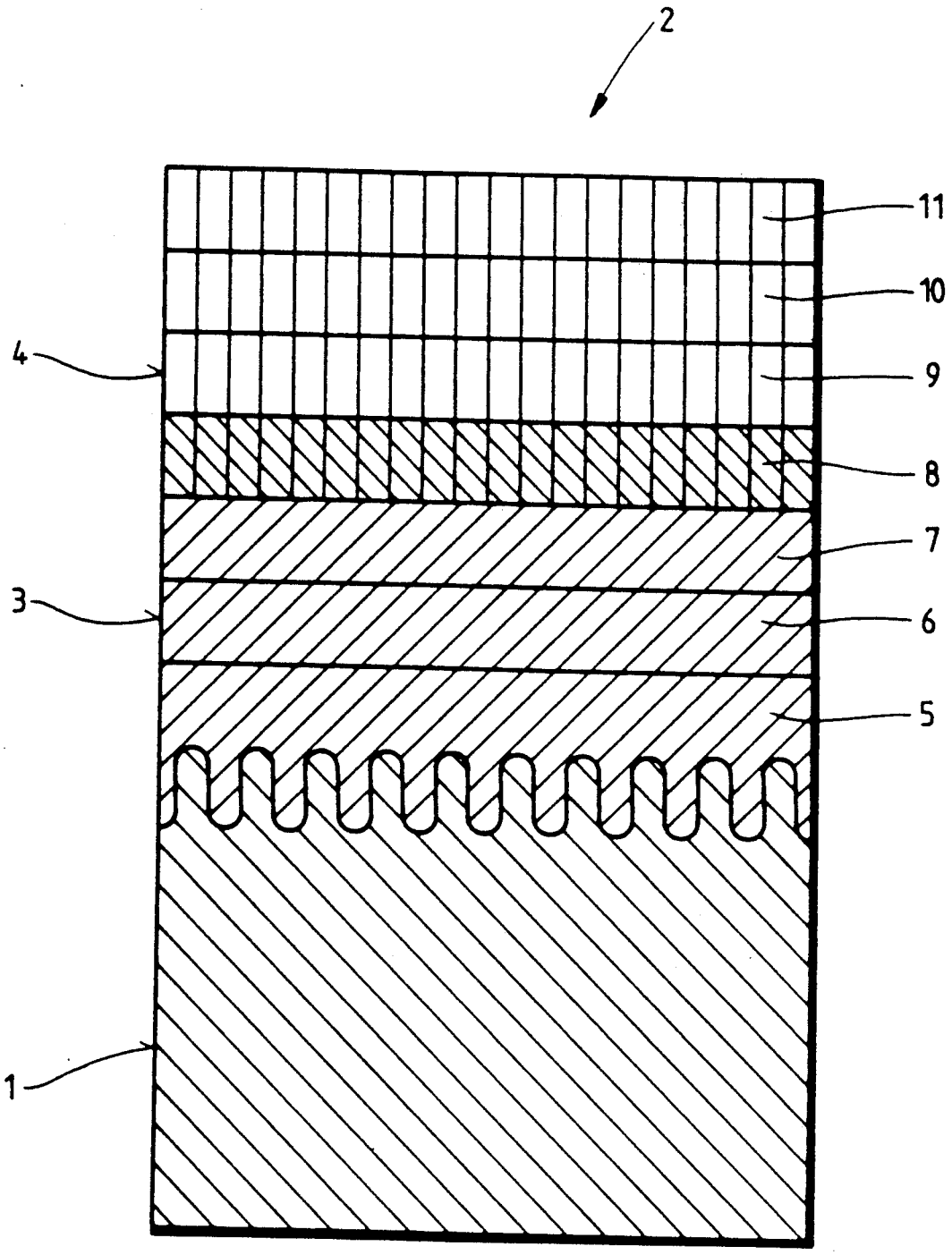
2
11
10
4
9
8
7
3
6
5
1

PROCESS FOR PLASTIC COATING, AND COATING PRODUCED BY THE PROCESS

This is a continuation of Ser. No. 07/088,946 filed Aug. 24, 1987 now abandoned.

TECHNICAL FIELD OF THE INVENTION

This invention relates to a process for plastic coating, more particularly powder coating, and to a coating produced using the process.

BACKGROUND OF THE INVENTION AND PRIOR ART

In the surface protection of surfaces resistant to high temperatures, in particular of metallic materials, there are many kinds of coating systems comprising multilayer coatings that substantially increase the life of the underlying material in aggressive environments. Coating systems are known that afford protection against both corrosion and chemical attack. In this respect fluoroplastic coatings are outstanding, since they afford excellent protection against chemicals and are not attacked by either strong acids or solvents. In addition to their well-known mechanical properties such as high resistance to abrasion and good elasticity the thermal properties of the fluoroplastics also allow them to be used just as they are even when prolonged exposure to temperatures up to 260° is involved.

Like other plastics, however, fluoroplastics exhibit permeability to gases, liquids and solutions. In the case of many fluoroplastics this is very pronounced. However, this permeability, which is a big disadvantage for coating material applications, rapidly decreases as the thickness of the layer increases, and is of no practical importance with thicker layers. Hence in coating with fluoroplastics the aim is to have relatively thick layers when attack on the substrate is to be prevented in the case of aggressive gases, liquids or solutions.

In addition vapour diffusion occurs, i.e. gaseous molecules penetrate the plastic layer and attack the underlying material. Here too the problem is solved by a thicker plastic layer.

However, the thickness of the layers that can be used is not unlimited, since the properties of the plastic materials themselves, particularly of the fluoroplastics, must be taken into account, and in addition thicker layers involve substantial increases in costs. Thus a good way of powder coating has been found to be the electrostatic application of fluoroplastics, in which the plastic has an insulating effect, at least from a certain thickness, and then only needs to be melted on. The difficulty with powder coating is that on sintering the fluoroplastic, i.e. in its molten phase and when the layer exceeds a certain thickness, it obeys the laws of gravity and runs off from the underlying material. To counter this it is necessary to rotate the parts to be coated while melting the fluoroplastic layers in the furnace.

Another method used to counter this running off and to enable thicker layers to be applied is to build in mechanical supports, for example carbon fibres, having properties such that they can be applied electrostatically even in thick layers. Despite these supplementary measures known coating systems can only be built up to a maximum thickness of 800 to 1500 μm. This limited thickness of the known coating systems has however generally proved to be inadequate where the environment is particularly aggressive, for example in chemical plant.

OBJECT OF THE INVENTION

The object of the invention is to provide a process by which coatings of any desired thickness that obviate effects due to permeability can be economically applied or produced.

THE INVENTION

According to the invention, this object is achieved by a process in which the flowability of a previously applied layer is maintained below its run-off limit while applying a subsequent layer. This can be done for example by variation of the processing temperature so that, while applying the subsequent layer, it is kept below the limit at which run-off caused by gravity occurs in the layer previously applied. It is preferable if each covering layer built up on a base layer consists of at least two partial layers and if, proceeding layer by layer outwards from the base layer, the melting point of the material of the layer decreases and its flowability increases, or at least is the same.

Preferably fluorothermoplastics are used in the process, and are advantageously applied in the following manner:

(a) the base layer is first built up to a thickness that is less than the run-off limit of the material at the processing temperature of the first partial layer of the covering layer;

(b) then at a processing temperature at which the base layer and the covering layer fuse together, the first partial layer of the covering layer is built up to a thickness that is still at least slightly below the run-off limit;

(c) at least one further partial layer of the covering layer is then built up at a processing temperature lower than that of step (b), which ensures adequate film formation and bonding to the previously applied layer and does not exceed the run-off limit of the whole layer under gravity.

The invention is based on the observation that at a given temperature at which fusion to a continuous coating film occurs, plastics applied by powder coating, in particular fluorothermoplastics, can only be applied up to a given limiting layer thickness; at greater thicknesses unavoidable run-off of the material according to the laws of gravity sets in. This limiting layer thickness for a given, i.e. specified, material (with a given flowability) at a given, i.e. specified, temperature above the melting point is hereinafter called the gravity run-off limit. The process of the invention prevents the run-off caused by gravity, which is otherwise unavoidable with powder coatings produced by the multilayer process when the limiting layer thickness is reached, by the following measures (when partial layers are referred to here and hereinafter, this is to be understood as measuring that the covering layer in question, and preferably also the base layer, comprises at least two partial layers, and that these partial layers of the said base or covering layer consist of the same fluorothermoplastic with the same melting point and/or flowability):

(a) First of all the base layer is applied to a component having at least one surface resistant to elevated temperatures, for example of ceramic, porcelain or high-temperature resistant plastics, or preferably of metal. In the course of this the thickness of the whole base layer is kept to a value that is still beneath the gravity run-off limit of the material of the basis layer.

(b) At the processing temperature for the base layer the first partial layer of the (first) covering layer is now applied at a thickness up to a thickness that, together with the base layer already present, is still at least slightly below the gravity run-off limit, whereby the processing temperature ensures fusion of the base layer with the first partial layer to a firm bond. The fluorothermoplastic of the (first) covering layer here has a lower melting point and/or a higher flowability than the material of the base layer.

(c) The second and any further partial layers of the covering layer are then applied at a lower processing temperature. The processing temperature in this step must still be high enough to ensure that the melt flows sufficiently to form a film and to bond with the previously applied layers, but it must be kept low enough, having regard to the lower flowability of the base layer, to ensure that the gravity run-off limit of the base layer, even together with the covering layer material that has now been applied, is not exceeded.

(d) The steps described can be correspondingly repeated in applying a second, third and further covering layers; these covering layers similarly being applied as at least two partial layers.

The idea on which the invention is based is thus that when the next layer is applied by powder coating, the flowability, i.e. the flow properties in the melt, of the preceding layer or layers, is always kept sufficiently low that it cannot run off under gravity. Consequently materials can be used for the base layer and the covering layers that have such different flowabilities that run-off of the preceding layer does not begin even on working at the same processing temperature above the melting point of the materials, which could then be the same for all the materials.

An advantageous proposal is to use for the base layer and the covering layers fluorothermoplastics that are melt-processable, i.e. can be processed from the melt, and are such that the material of the upper covering layer at any time has a melting point lower by at least 10° C. and a higher flowability compared with the fluorothermoplastic of the layer beneath it. In this case the processing temperature of the last partial layer of the upper layer can lie beneath the melting point of the material of the layer beneath it, so that even with relatively small differences in the processing temperatures, for example of little more than 10° C., fusion and film formation with the following layer is achieved.

It is preferred to use materials (fluoroplastics) whose melting points differ by 30° to 150° C., preferably by 70° to 150° C.; at a given processing temperature the flowability of the upper layer can then be higher or even substantially the same as that of the layer below it. It is thus also possible, even in the case of materials with approximately the same flowability, to select a sufficiently large difference in the processing temperatures, such that the melting point when applying the second partial layer of the upper layer is far enough below the melting point of the layer beneath it, and run-off is precluded.

To improve the adhesion of the base layer to the metal substrate, measures in addition to or instead of mechanical treatment of the substrate, for example by sand blasting, can be used. Thus before the application of the base layer ceramic or metallic intermediate layers can be applied, for example by flame spraying or by electrochemical means or by sprinkling on and sintering of powders. An improvement in adhesion can for example also be achieved by means of adhesion-promoting intermediate layers of chromates or phosphates, and also by etching the substrate with acids or by electrochemical means. Finally a conventional primer layer of a fluorothermoplastic, preferably that of the base layer, and an adhesion promoter such as, for example, lithium polysilicate or chromic acid and/or phosphoric acid, can be applied to the substrate from a dispersion, dried and, if desired, baked on, before the base layer is applied. In addition any heat-resistant pigment can be added to the powder coating material. Furthermore additions that effect mechanical strengthening or increase the hardness and abrasion resistance can be used, i.e. added, for example carbon fibres, glass fibres or glass beads.

By means of coating according to the invention a two-stage build-up of the coating up to a thickness of almost twice that of the known coatings can be achieved, with a considerable improvement in life. In addition, in contrast to known stuck-on coatings, even complicated shapes can be thickly coated without additional effort; besides this the coating is vacuum tight even at high temperatures, while in contrast to this the adhesive separates from coverings.

Fluorothermoplastics from which the necessary powder coating materials of different flowability at a given processing temperature can be selected include fluorothermoplastics or fluoropolymers that behave predominantly thermoplastically, insofar as they can be processed from the melt, that is to say, can be shaped by forming processes for thermoplastics, for example by calendering, injection moulding or extrusion, and which are also able to form a continuous film from the melt. Such fluorothermoplastics that can be processed from the melt usually have a melt viscosity of less than $1.10^6$ Pa s, and thereby differ from polytetrafluoroethylene and its modifications, which have such a high melt viscosity that processing from the melt is not possible.

Examples of fluorothermoplastics that can be processed from the melt are homopolymers such as polyvinylidene fluoride, polyvinyl fluoride or preferably polychlorotrifluoroethylene. Likewise the materials required for the powder coating may be copolymers, above all those that also contain, besides TFE or CTFE, at least one further ethylenically unsaturated monomer in an amount sufficient to ensure that they can be processed from the melt. Such copolymers are selected from the following group (hereinafter the following abbreviations are used:

TFE = tetrafluoroethylene,
CTFE = chlorotrifluoroethylene,
HFP = hexafluoropropylene,
PAVE = perfluoroalkyl vinyl ether,
E = ethylene,
VDF = vinylidene fluoride):

Copolymers of TFE with (a) HFP or higher perfluoroolefins of the formula $CF_3{=}CF{-}Rf1$, wherein Rf1 is a perfluorinated alkyl group with 1 to 10 carbon atoms in a straight or branched chain;

(b) PAVE of the formula $CF_2{=}CF{-}O{-}Rf2$, wherein Rf2 is a perfluorinated alkyl group with 1 to 5 C atoms in a straight or branched chain, preferably with perfluoropropyl vinyl ether;

(c) HFP and PAVE, especially HFP and perfluoropropyl vinyl ether (PPVE);

(d) Ethylene, such polymers of the TFE/E type preferably also containing at least one, or frequently two, further ethylenically unsaturated comonomers, which are in particular selected from the following groups:

($d_1$) perfluorinated olefins of the formula $CF_2{=}CF{-}Rf1$, where Rf1 is a perfluoroalkyl group with 1 to 10, preferably 1 to 5 C atoms; HFP is most preferred;

($d_2$) PAVE of the formula $CF_2{=}CF{-}O{-}Rf2$, where Rf2 is a perfluoroalkyl group with 1 to 5 carbon atoms, particularly PPVE;

($d_3$) perfluorinated vinyl ethers of the formula $CF_2{=}CF{-}O{-}[{-}CF_2{-}CF(CF_3){-}O{-}]{-}CF_2{-}CF_2{-}CF_3$. where n = 1 to 4, and is preferably 1 or 2;

($d_4$) perfluoroalkyl substituted vinyl compounds of the formula $CH_2{=}CH{-}Rf3$, where Rf3 is a perfluoroalkyl group with 2 to 10, preferably 2 to 6 carbon atoms;

($d_5$) fluorine-containing olefins of the formula $CH_2{=}CRf4{-}Rf3$, where Rf4=F or $CF_3$ and Rf3 is a perfluoroalkyl group with 1 to 10 C atoms;

($d_6$) 1,1,1-trifluoro-2-(trifluoromethyl)-4-penten-2-ol $CH_2{=}CH{-}CH_2{-}C(CF_3)_2{-}OH$;

($d_7$) allyl-1-hydroxy-hexafluoroisopropylether $CH_2{=}CH{-}CH_2{-}O{-}C(CF_3)_2{-}OH$;

($d_8$) vinyl esters of the general formula $CH_2{=}CH{-}O{-}CO{-}R$, where R is an alkyl group with 1 to 3 C atoms and is preferably a methyl group;

($d_9$) α-olefins with 3 to 4 C atoms, preferably isobutylene;

($d_{10}$) acrylic acid esters and methacrylic acid esters, preferably their methyl to butyl esters;

($d_{11}$) VDF, and ($d_{12}$) CTFE.

Such terpolymers and quaterpolymers, that can be formed by the incorporation of further ethylenically unsaturated monomers into copolymers of the TFE/E type, usually comprise 55 to 40 mol. % TFE, 60 to 40 mol. % E and 0.5 to 10 mol. % of the third and possible fourth monomers.

(e) VDF, such copolymers preferably containing (besides TFE and VDF) at least one further ethylenically unsaturated and preferably fluorine-containing comonomer; for this purpose HFP or PAVE are of particular interest, and possibly also combinations of the two: in these copolymers the proportion of TFE present is 50 to 80, in the case of the ter- and quaterpolymers it is 50 to 65 mol. %, and the proportion of VDF present is more than 20 mol. %. A preferred combination is TFE/VDF/HFP.

(f) Chlorotrifluoroethylene, in which case TFE or CTFE can be the predominant constituent.

Copolymers of CTFE with (g) ethylenically unsaturated, fluorine-containing monomers, in particular HFP, TFE and VDF, and preferably terpolymers with two of these comonomers;

(h) ethylene, in which case the copolymers can preferably contain a further ethylenically unsaturated comonomer, and frequently two, which can be selected from the same group as is set forth above under (d) in the case of the copolymers of the TFE/E type.

With regard to the production of copolymers of the above-mentioned kind reference is made, by way of example, to the following U.S. Pat. Nos. 2,946,763, 3,132,123, 3,132,124, 4,029,868, 4,262,101, 3,624,250, 3,859,262, 3,817,951, 3,960,825, 3,847,881, 4,123,602, 2,468,054, 3,235,537, 2,513,312, 2,662,072, 3,053,818, 2,738,343, 2,752,332; and also to the European patent specifications 2 809 and 50 437 and to Belgian patent specification 844 965.

From these fluorothermoplastics that can be worked from the melt and are in principle suitable for use in the process of the invention a large number of pairs can be chosen with a lower and a higher flowability at a given processing temperature or with a higher and a lower melting point that are suitable for application as a base and covering layer. The fluorothermoplastics concerned can be composed of comonomers of different kinds: without being limited thereto, the following examples of pairs that can form the base and covering layers are given:

| Base layer: Homo- or co-polymers (of) | Covering layer: Homo- or co-polymers (of) |
|---|---|
| TFE/PPVE | TFE/HFP |
| TFE/PPVE/HFP | TFE/HFP |
| TFE/PPVE or TFE/PPVE/HFP or TFE/HFP | TFE/E (ter- or quaterpolymers) or CTF/E (ter- or quaterpolymers) |
| TFE/PPVE or TFE/PPVE/HFP or TFE/HFP or PCTFE or TFE/E; CTFE/E (ter- or quaterpolymers) | PVDF or VDF co-polymers, preferably TFE/VDF/HFP. |

Systems with a base layer and two different covering layers can be built up in this way, as is shown by the following examples:

| Base layer: polymers (of) | 1st Covering layer: polymers (of) | 2nd Covering layer: polymers (of) |
|---|---|---|
| TVE/PPVE or TFE/PPVE/HFP | TFE/HFP | PVDF or VDF-copolymers (preferably TFE/VDF/HFP) or TFE/E or CTFE/E (ter- or quaterpolymers) |
| TFE/HFP | TFE/E or CTFE/E | PCTFE |

There is preferably a difference in melting point of at least 30° C. between fluorothermoplastics of the individual layers, that is to say in each case the layer closer to the substrate (the surface to be coated) has a melting point that is higher by at least 30° C. than that of the layer applied to it.

Fluorothermoplastics that are particularly suitable for the process of the invention, since they are particularly mutually compatible and bondable, are those having the same comonomer units but in different molar proportions, whereby different melting points or different flowabilities can be obtained. These are in particular ter- and quaterpolymers of the TFE/E or CTFE/E types containing from 20 to 60 mol. % of TFE or CTFE and 40 to 60 mol. % of E, in which the proportion of the third (or of the third and fourth as the case may be) comonomer or comonomers can be varied in the range from 0.5 to 30 mol. %. Such third (and possibly fourth) comonomers are preferably HFP, PPVE, fluorinated olefins of the above-mentioned formula $CH_2{=}CHRf3$ and 3,3,3-trifluoro-2-trifluoromethylpropylene. In this way it is possible, for example, to obtain terpolymers having the qualitative composition TFE/E/HFP but having melting points of, for example, 200° C., 240° C. and 270° C. as a result of changing the content of HFP: these materials can be combined, when making two-layer or three-layer systems by powder coating in accordance with the invention, wherein a copolymer with a lower melting point is always applied to the preceding layer.

Such combinations of ter- and quaterpolymers of the TFE/E and CTFE/E types with different contents of third and possibly fourth comonomers constitute a preferred embodiment of the invention.

It is also known, in the field of fluorothermoplastics, to prepare copolymers having a composition that is the same except in that they have very different molecular weights. Although such copolymers can have the same or approximately the same melting point, the higher molecular weight results in a lower, and the lower molecular weight in a higher, flowability at a given processing temperature above the melting point. Different molecular weights are obtained by the known use in the copolymerisation of molecular weight controlling chain transfer agents. A higher concentration or a higher activity of the chain transfer agent leads to increased lowering of the molecular weight. Within the scope of the process according to the invention it is thus possible, in principle, even to use fluorothermoplastics having the same composition and the same melting point, but with different molecular weights and flowabilities, provided the layer nearer to the substrate always has the higher molecular weight and thus the lower flowability. According to a further preferred embodiment of the invention fluorothermoplastics are selected that have the same composition but different molecular weights, with each successive material, proceeding from the base layer in the direction of the uppermost covering layer, has a melting point lower by at least 10° C. and a lower molecular weight.

A preferred way of applying a coating comprising one or two layers, each built up in stages, is as follows:

(a) Pretreatment of the high temperature resistant surface;

(b) Application of the first partial layer of the base layer to the hot surface;

(c) Sintering the first partial layer at the baking temperature of the fluorothermoplastic selected for the base layer;

(d) Application of the further partial layers of the base layer, in stages as the case may be, each of the partial layers being applied to the hot surface of the preceding partial layer and being sintered, after the application of each partial layer, at the baking temperature of the fluorothermoplastic selected for the base layer;

(e) Application of the first partial layer of the covering layer, which has a lower melting point than the base layer, to the fused base layer and sintering at a temperature above the melting point of the base layer;

(f) Application of the further partial layers of the covering layer in stages, each partial layer being applied to the hot surface of the preceding partial layer and being sintered, after the application of each partial layer, at a temperature below the melting point of the base layer.

The preceding steps (a) to (f) will now be described in more detail for a metallic component to be coated, e.g. a sheet or a connector such as a bolt or a screw, it being understood that the pretreatment mentioned in (a) comprises in particular annealing followed by sand blasting or flame spraying and the associated preheating of the metal part.

By annealing at a temperature of about 400° C. the metal surface is rendered completely grease-free; the metallic material to be coated is then only handled with cotton gloves. The sand blasting can be done with a corundum, in which case the carrier should be pure, or alternatively the surface can be flame sprayed. The surface of the substrate material can be prepared by means of abrasive paper, since by this means any peaks on the material are rubbed off. The preheating of the workpiece assists the intimate bonding of the workpiece to the first partial layer of the base layer that is applied to the hot workpiece according to (b). The coating material can for example be applied electrostatically with a powder pistol or by melting on. The sintering of the first partial layer according to (c) should last for about 45 minutes. In the stepwise application of the further partial layers of the base layer according to (d), in which the thickness of each single partial layer can correspond to the total thickness divided by the number of steps, the duration of the sintering after each partial layer, until the final thickness of the layer is reached, is about 45 minutes. Thereafter, according to (e), the first partial layer of the covering layer having a lower melting point is applied to the base layer and fused to the base layer at a temperature above the melting point of the base layer. The application of the coating layer in stages according to (f) corresponds to the stages of the application of the base layer, described in (d), though with the difference that the partial layers of the covering layer are fused at a temperature below the melting point of the base layer.

BRIEF DESCRIPTION OF THE DRAWINGS

The invention will now be explained in more detail with reference to a preferred build-up of a coating for a metallic component, within the scope of the invention, shown diagrammatically and on an enlarged scale in the accompanying drawing.

DETAILED DESCRIPTION OF A PREFERRED EMBODIMENT OF THE INVENTION

The surface of a substrate material 1 that has been completely degreased by annealing and roughened to a depth of 5 to 10 μm by sand blasting is protected by a coating 2 that comprises a base layer 3 and a covering layer 4 thereupon. The base layer and the covering layer 3, 4 are each applied as several partial layers. For the base layer in the example shown, a copolymer is used that consists of tetrafluoroethylene, ethylene and hexafluoropropylene and has a melting point of 267° C., and for the covering layer a copolymer is used that similarly consists of tetrafluoroethylene, ethylene and hexafluoropropylene but has a melting point of 200° C.

In the example shown the base layer 3 consists of three partial layers 5 to 7 and the coating layer 4 of four partial layers 8 to 11. Starting from a maximum possible thickness of 1000 μm each for the base and covering layers 3, 4, the thickness of the three-stage base layer totals 750 μm, i.e. each partial layer 5 to 7 is 250 μm thick, while in contrast the coating layer 4, with a thickness of 1000 μm, is made up of four partial layers 8 to 11 each of 250 μm. The loss of a possible fourth partial layer of the base layer 3 was accepted in order to approximately double the total thickness of the coating 2 compared with known coating, in that in place of a fourth partial layer of the base layer 3 the first partial layer 8 of the coating layer 4 already consists of a material with a lower melting point compared with the base layer 3 and an increased, at least approximately the same flowability. The running-off under gravity of the coating material that would otherwise unavoidably occur with a fourth partial layer of the base layer 3 can then be prevented, since for fusing the partial layers 9 to 11 a temperature below the melting point of the base layer 3 is used and thus fusion of the basis layer 3 is prevented.

What is claimed is:

1. A process of powder coating a high temperature resistant surface with fluorothermoplastics material comprising:

(a) applying to said surface a base layer of a powdered fluorothermoplastics material having a first melting temperature and sintering the base layer at a baking temperature of the first thermoplastics material selected, (b) then applying over the base layer a covering layer of a powdered second fluorothermoplastics material having a lower melting temperature and the same or increased flowability than said first melting temperature, and heating the covering layer to a temperature below said first melting temperature to fuse the coating.

2. The process according to claim 1, and the further steps of:

(a) initially building up the base layer to a thickness which is below the run-off limit of the fluorothermoplastic material at the processing temperature of the first partial layer of the first covering layer, (b) then building up the first partial layer of the covering layer at a processing temperature at which the base layer and the first partial layer melt to a thickness which is slightly below the run-off limit, and (c) then building up at least one further partial layer of the covering layer at a processing temperature which is lower than that of step (b), but which ensures adequate film formation and bonding with the previously applied layer and which does not exceed the run-off limit due to gravity of the whole covering layer.

3. The process according to claim 1, in which the fluorothermoplastic material of the covering layer has a melting point which is at least 10° C. lower and a flowability which is higher than that of the fluorothermoplastic material of the layer below.

4. The process according to claim 1, in which the fluorothermoplastic material of the covering layer has a melting point which is at least 30° C. lower than that of the layer below.

5. The process according to claim 1, in which the fluorothermoplastic material applied as the base layer and covering layer is a copolymer which is processable from the melt and is comprised of tetrafluoroethylene and at least one additional ethylenically unsaturated monomer which is copolymerizable with tetrafluoroethylene.

6. The process according to claim 1, in which the fluorothermoplastic material applied as the base layer and covering layer is a copolymer which is processable from the melt and is comprised of tetrafluoroethylene and at least one ethylenically unsaturated comonomer which is copolymerizable with tetrafluoroethylene, wherein the copolymer is comprised of different comonomers from layer to layer.

7. The process according to claim 1, in which the fluorothermoplastic material applied as the base layer and covering layer is a copolymer which is processable from the melt and is comprised of tetrafluoroethylene and at least one ethylenically unsaturated comonomer which is copolymerizable with tetrafluoroethylene, wherein the copolymer comprising the upper layer has a higher flowability at the processing temperature than the copolymer comprising the layer below the upper layer.

8. The process according to claim 1, in which the fluorothermoplastic material applied as the base layer and covering layer is a copolymer which is processable from the melt and is comprised of tetrafluoroethylene and at least one additional ethylenically unsaturated monomer which is copolymerizable with tetrafluoroethylene, wherein the copolymer comprising the upper layer has a melting point that is lower than that of the copolymer comprising the layer below the upper layer.

9. The process according to claim 1 further comprising the steps of:

(a) pretreating the surface to be coated, including heating the surface;

(b) applying a first partial layer of the base layer to the hot surface;

(c) sintering the first partial layer at the baking temperature of the fluorothermoplastic material selected for the base layer;

(d) applying additional partial layers of the base layer step-wise on the hot surface of the previous partial layer and sintering each applied partial layer at the baking temperature of the fluorothermoplastic material selected for the base layer;

(e) applying a first partial layer of the covering layer on the base layer, the melting point of the covering layer being lower than that of the base layer, and sintering at a temperature above the melting point of the base layer; and (f) applying at least one additional partial layer of the covering layer stepwise on the hot surface of the previous partial layer and after applying the additional partial layer, sintering at a temperature below the melting point of the base layer.

10. The method according to claim 1, in which the base layer is applied with additives which promote curing.

11. A process as claimed in claim 1, wherein applying further covering layers of powdered fluorothermoplastics materials over the covering layer which further covering layers comprise materials selected so that each has a lower melting point than the material of the preceding layer and heating each layer to a temperature below the melting point of the material of the preceding layer.

* * * * *